US009140020B2

(12) United States Patent
Torres-Pinzon

(10) Patent No.: US 9,140,020 B2
(45) Date of Patent: Sep. 22, 2015

(54) ASSEMBLY FOR WOOD FLOORS AND VENEERS

(71) Applicant: Roman Torres-Pinzon, Bogata (CO)

(72) Inventor: Roman Torres-Pinzon, Bogata (CO)

( * ) Notice: Subject to any disclaimer, the term of this patent is extended or adjusted under 35 U.S.C. 154(b) by 0 days.

(21) Appl. No.: 14/135,643

(22) Filed: Dec. 20, 2013

(65) Prior Publication Data

US 2014/0318065 A1 Oct. 30, 2014

(30) Foreign Application Priority Data

Apr. 30, 2013 (CO) ..... 13-108731

(51) Int. Cl.
*E04F 15/22* (2006.01)
*E04F 15/02* (2006.01)
*E04F 15/04* (2006.01)

(52) U.S. Cl.
CPC ..... *E04F 15/02044* (2013.01); *E04F 15/04* (2013.01); *E04F 2015/02094* (2013.01)

(58) Field of Classification Search
CPC ... E04F 15/02044; E04F 15/225; E04F 15/04; E04F 2201/0153; E04F 2201/023; E04F 2201/05; E04F 2201/0123
USPC ..... 52/403.1, 480, 489.1, 506.1, 506.08, 52/582.1, 586.1, 586.2, 589.1, 710, 711
See application file for complete search history.

(56) References Cited

U.S. PATENT DOCUMENTS

| | | | | |
|---|---|---|---|---|
| 1,893,481 | A * | 1/1933 | Adams | 52/489.1 |
| 2,066,255 | A * | 12/1936 | Demsey | 52/506.08 |
| 3,405,493 | A * | 10/1968 | Omholt | 52/480 |
| 3,619,963 | A * | 11/1971 | Omholt | 52/481.1 |
| 4,620,403 | A * | 11/1986 | Field | 52/480 |
| 2006/0059822 | A1 * | 3/2006 | Guffey | 52/480 |
| 2012/0255253 | A1 * | 10/2012 | DeZaio | 52/475.1 |

* cited by examiner

*Primary Examiner* — Brian D Mattei
(74) *Attorney, Agent, or Firm* — Hoglund & Pamias, PSC; Robert J. Rios

(57) ABSTRACT

The invention provides an assembly for building wood floors or veneers consisting of three elements: a metallic profile with a design that allows supporting a wood or similar material plate, a coupling staple that is supported on a sloping wall of the profile and couples its base on a slot positioned along the width of the wood plate and that allows the adjacency of other floor or veneer plates.

3 Claims, 2 Drawing Sheets

ASSEMBLY FOR WOOD FLOORS AND VENEERS

FIELD OF THE INVENTION

This invention is directed to the field of wood constructions, specially the construction of floors and veneers with wood plates or alternative other similar materials such as plastics or alike could be used. Specifically, the invention is directed to the manual assembly using a metallic profile configured to hold and slide a coupling staple that adjust on a wood plate inside a slot or groove made on the width of such plate.

BACKGROUND OF THE INVENTION

Traditionally glues, adhesives and fixation tools such as nails, tacks, screws and others are used in the field of wood floors and veneers manufacturing. The assembly model of the present invention proposes a manual coupling based on three elements that eliminates the need any tools or materials for its assembly. These three elements are the wood plate, provided with a grooved on its width, a rail or profile specially designed to allow the assembly and a coupling staple in the wood slot that facilitates join the plates that conform the floor or veneer. The assembly of the present invention is designed in such a way that the three elements mentioned above and their interrelation guarantee stability and consistency in the construction of hand-made floors or veneers.

BRIEF DESCRIPTION OF THE DRAWINGS

The invention shall be understood from the following figures.

DETAILED DESCRIPTION OF THE INVENTION

Figure 1:
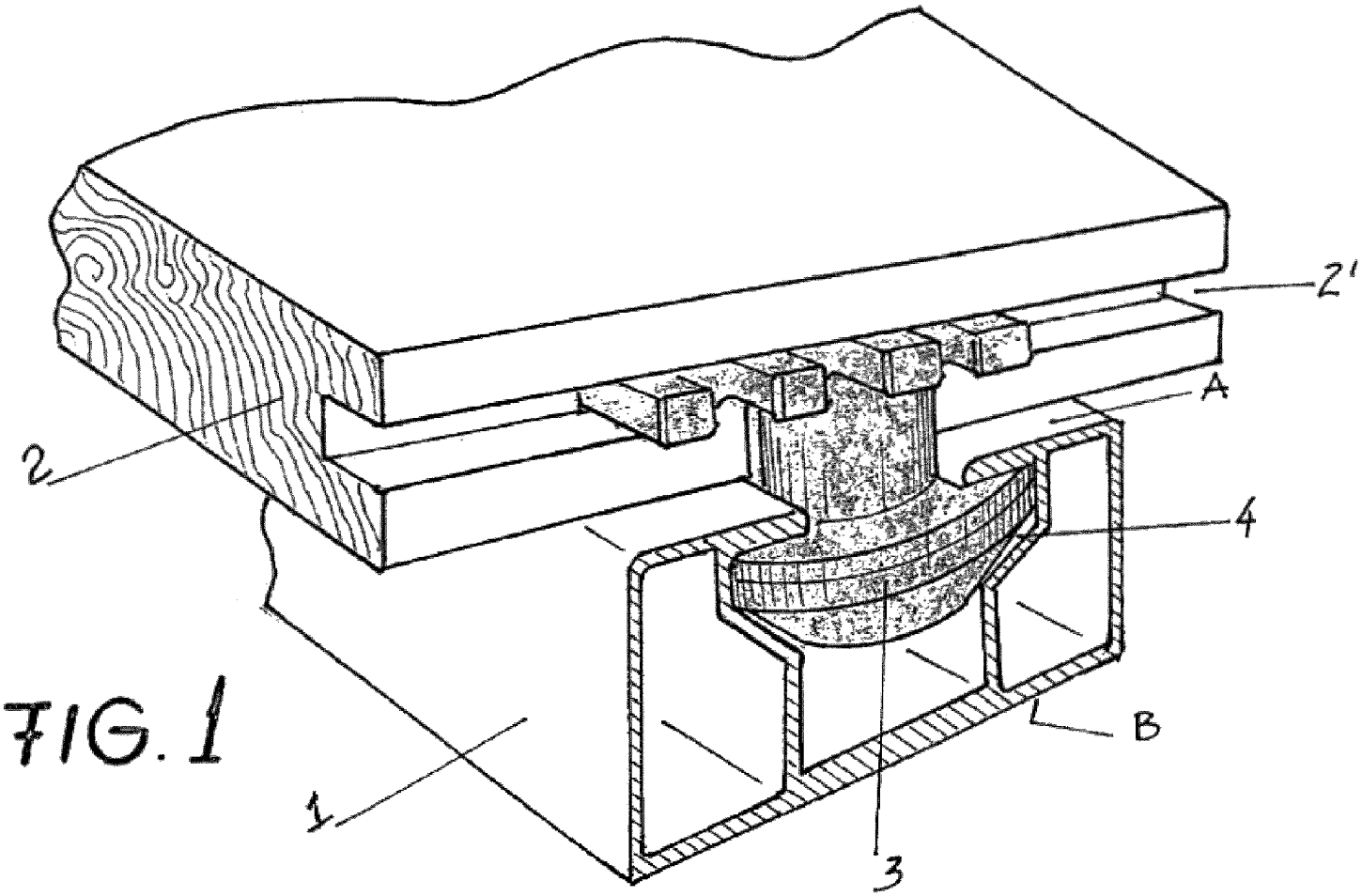
FIG. 1 shows a cross-section view of the assembly with the three elements: profile, plate and staple.
Figure 2:
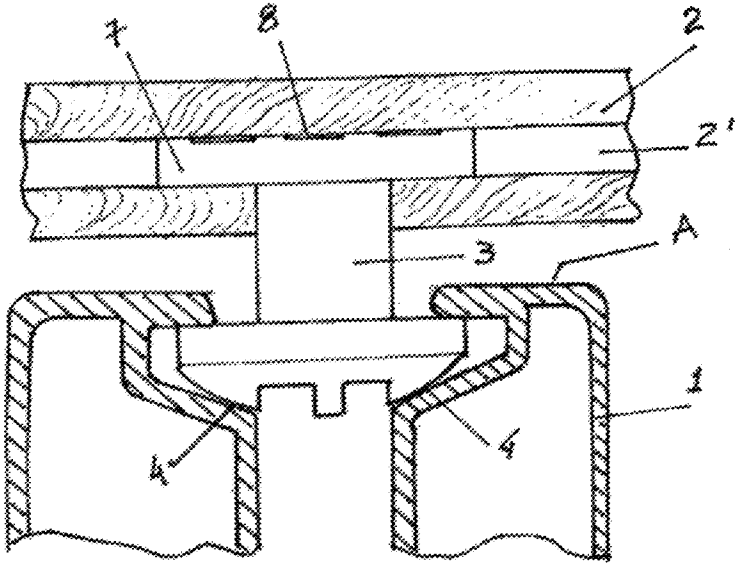
FIG. 2 shows a front view of the model assembly.

According to FIGS. 1 and 2, the assembly of the invention consists of an extruded aluminum metallic profile (1) with a symmetric conformation with regard to the central axis with flat sides or bases (A) and (B) that supports on the top base a wood rectangular plate (2) having on its width and length slots (2) in each side, and a piece or staple (3) that allows the coupling between two wood plates (2) adjacent to the intermediate slot (2).

Figure 4:
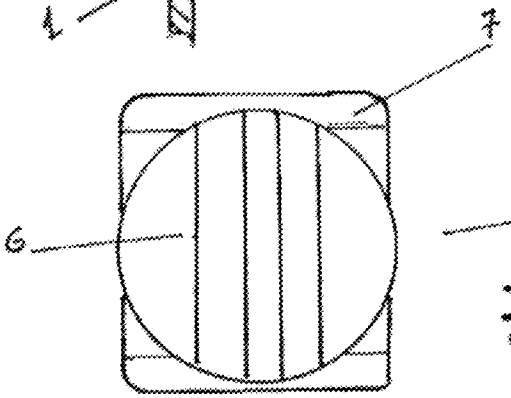
FIG. 4 shows a top view of the coupling staple between the wood profile and plate.

This staple (3) is an element made of plastic and according to FIGS. 2 and 4, it has a button shape with aft spherical slotted cap head (6) held in an intermediate column that end in a base (7) slotted with grooves (8) on the lower face. The staple's head or cap (3) makes contact on a point (4) on a ramp or inclination of the profile inner walls (1) providing support and ease of sliding on such sloping planes, while the rectangular base (7) matches or couples with the slot (2') on the wood plate width (2).

Grooves (8) on the staple base (7) serve to assemble the base with wood through a slot with a rigidity to counteract oscillating motions on wood plates assembled when they are stepped in the case of floors, as seen in the partial view of FIG. 2.

Figure 3:
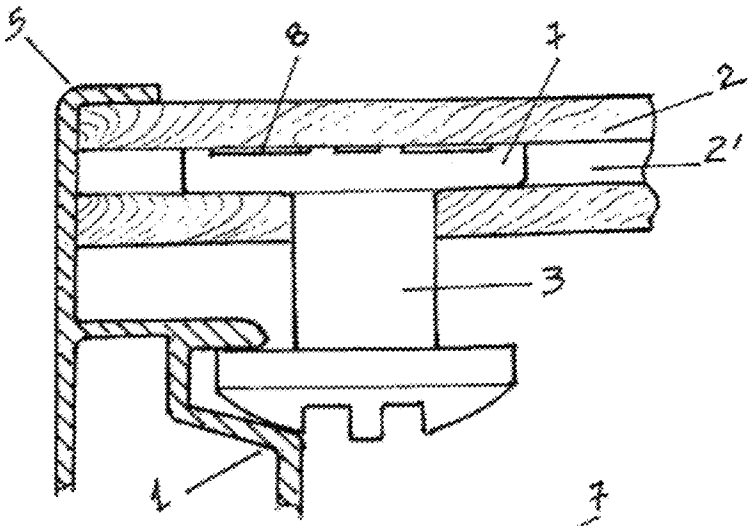
FIG. 3 shows an alternative embodiment of the assembly with a varied profile.

FIG. 3 shows an alternative variation of the profile (1) in which one wing extends to a wall (5) with a folded end that acts as a wall framework in the case of veneers, without altering, for example, the functionality of the other two assembly elements. The staple (3) of the invention has a cap-shaped spherical head that may have another configuration such as a parallelogram on its head with sloping sides. These staples allow the woods to be coupled not only adjacently parallel to the plates but for intersection coupling in any angles when conforming floors in non-regular polygonal areas. This benefit is because the staple in any of the modalities described above, allows turning supported on the profile sloping wall.

The invention claimed is:

1. An assembly for floors and veneers comprising:

a metallic profile having: a top side with an outer surface and an inner surface, a bottom side with an outer surface and an inner surface and an inner cavity defined by: a pass-through opening located at said top surface, the inner surface of said top side, and two cavity walls, each cavity wall including a first part extending perpendicular to the inner surface of said top side, a second part extending from an end portion of an inclined angle with respect to said first part, and a third part extending from an end portion of said second part and coupled perpendicular to the inner surface of said bottom side; and a staple including: a head element having an upper surface and a lower surface with an inclined portion, a base portion having an upper surface and a lower surface and an intermediate column having a first end coupled to the upper surface of said head element and another end coupled to the lower surface of said base portion, wherein said base portion is configured to be inserted into a slot longitudinally extending along the width of a floor or veneer plate and said head element is configured to be inserted into the inner cavity of said metallic profile so that: the intermediate column passes through said pass-through opening, the inclined portion of the lower surface of said head element rests on the angled second parts of said two cavity walls.

2. The assembly for floors and veneers of claim 1, wherein the metallic profile further comprises a wing-shaped extension with a folded end configured to frame an upper surface of said floor or veneer plate.

3. The assembly for floors and veneers of claim 1, wherein the head and the base portion of said staple are provided with grooves for cushioning the movement of said floor or veneer plate.

* * * * *